US010207275B2

(12) United States Patent
Donda

(10) Patent No.: US 10,207,275 B2
(45) Date of Patent: Feb. 19, 2019

(54) IRON ORE CONCENTRATION PROCESS WITH GRINDING CIRCUIT, DRY DESLIMING AND DRY OR MIXED (DRY AND WET) CONCENTRATION

(71) Applicant: VALE S.A., Rio de Janeiro (BR)

(72) Inventor: Joaquim Donizetti Donda, Lourdes (BR)

(73) Assignee: VALE S.A., Rio de Janeiro (BR)

( * ) Notice: Subject to any disclaimer, the term of this patent is extended or adjusted under 35 U.S.C. 154(b) by 457 days.

(21) Appl. No.: 14/063,478

(22) Filed: Oct. 25, 2013

(65) Prior Publication Data

US 2014/0117125 A1 May 1, 2014

Related U.S. Application Data

(60) Provisional application No. 61/719,143, filed on Oct. 26, 2012.

(51) Int. Cl.

| | |
|---|---|
| ***B02C 23/14*** | (2006.01) |
| ***B02C 23/20*** | (2006.01) |
| ***B03C 1/00*** | (2006.01) |
| ***B02C 23/08*** | (2006.01) |
| ***C22B 1/00*** | (2006.01) |
| *B02C 19/00* | (2006.01) |

(52) U.S. Cl.

CPC ..... *B02C 23/14* (2013.01); *B02C 23/08* (2013.01); *B02C 23/20* (2013.01); *B03C 1/002* (2013.01); *C22B 1/00* (2013.01); *B02C 19/0056* (2013.01)

(58) Field of Classification Search

CPC ..... B02C 19/0056; B02C 23/08; B02C 23/20; B03C 1/002; C22B 1/00

See application file for complete search history.

(56) References Cited

U.S. PATENT DOCUMENTS

| | | | | |
|---|---|---|---|---|
| 2,352,324 A * | 6/1944 | Hubler | ..... | B03D 1/02 209/166 |
| 2,877,954 A | 3/1959 | Myers | | |
| 2,911,730 A | 11/1959 | Schaub et al. | | |
| 2,962,231 A * | 11/1960 | Weston | ..... | B03B 9/00 241/24.14 |

(Continued)

FOREIGN PATENT DOCUMENTS

| | | |
|---|---|---|
| CA | 2 900 009 A1 | 12/2004 |
| CN | 1640815 A | 7/2005 |

(Continued)

OTHER PUBLICATIONS

"A discussion of magnetic separation techniques for concentrating ilmenite and chromite ores" by Dobbins et al. published by The South African Institute of Mining and Metallurgy in 2007; pp. 197-204.*

(Continued)

*Primary Examiner* — James S McClellan
*Assistant Examiner* — Peter Iannuzzi
(74) *Attorney, Agent, or Firm* — Arent Fox LLP

(57) ABSTRACT

The present invention discloses an advantageous and effective process for the concentration of iron ores, which can be fully dry or mixed, part of the process being dry, part wet. The invention thereby improves process efficiency as a whole by increasing recovery of concentrators and increasing the useful life of the mines.

6 Claims, 6 Drawing Sheets

(56) References Cited

U.S. PATENT DOCUMENTS

| | | | | | |
|---|---|---|---|---|---|
| 3,291,398 | A | * | 12/1966 | Weston | B03C 1/00 209/223.1 |
| 3,337,328 | A | * | 8/1967 | Lawver | B03B 9/00 209/166 |
| 3,502,271 | A | * | 3/1970 | Hays | B03D 1/02 209/164 |
| 3,746,265 | A | | 7/1973 | Dancy | |
| 3,754,713 | A | | 8/1973 | Kienast et al. | |
| 3,790,091 | A | | 2/1974 | Law et al. | |
| 3,885,744 | A | | 5/1975 | Drage | |
| 4,126,673 | A | | 11/1978 | Cromwell | |
| 4,192,738 | A | * | 3/1980 | Colombo | B03C 1/03 209/166 |
| 4,213,942 | A | * | 7/1980 | Thornton | B03B 9/00 209/10 |
| 4,256,267 | A | * | 3/1981 | Burton | B03B 9/00 209/12.2 |
| 4,295,881 | A | * | 10/1981 | Saville | C22B 1/00 209/39 |
| 4,398,673 | A | | 8/1983 | Gonnason | |
| 4,666,591 | A | | 5/1987 | Imai et al. | |
| 4,732,606 | A | | 3/1988 | Kobele et al. | |
| 4,747,547 | A | | 5/1988 | Harada | |
| 4,761,897 | A | | 8/1988 | Tazaki et al. | |
| 5,316,746 | A | | 5/1994 | Narita et al. | |
| 5,394,991 | A | | 3/1995 | Kumagai et al. | |
| 5,678,775 | A | | 10/1997 | Chapman | |
| 5,890,663 | A | | 4/1999 | Strach et al. | |
| 5,961,055 | A | * | 10/1999 | Lehtinen | B03C 1/00 241/24.14 |
| 6,258,150 | B1 | | 7/2001 | MacKellar | |
| 6,540,088 | B2 | | 4/2003 | Oder et al. | |
| 6,595,443 | B2 | | 7/2003 | Ottergren | |
| 7,172,074 | B2 | | 2/2007 | Bittencourt | |
| 7,172,143 | B2 | | 2/2007 | Vandeputte | |
| 7,802,685 | B2 | | 9/2010 | Allen et al. | |
| 8,074,905 | B2 | | 12/2011 | Schaefer et al. | |
| 8,157,193 | B2 | | 4/2012 | Avant, Jr. et al. | |
| 8,695,903 | B2 | | 4/2014 | Gillis | |
| 8,791,203 | B2 | | 7/2014 | Tadepalli et al. | |
| 8,864,900 | B2 | | 10/2014 | Janik et al. | |
| 9,156,035 | B1 | | 10/2015 | Horton et al. | |
| 9,212,404 | B2 | | 12/2015 | Gerold et al. | |
| 9,421,589 | B2 | | 8/2016 | Yoshi et al. | |
| 9,702,025 | B2 | | 7/2017 | Connelly et al. | |
| 2010/0176226 | A1 | | 7/2010 | Avant, Jr. et al. | |
| 2010/0294170 | A1 | | 11/2010 | Clemens et al. | |
| 2011/0113925 | A1 | | 5/2011 | Perry | |
| 2012/0325055 | A1 | | 12/2012 | Gerold et al. | |
| 2013/0032004 | A1 | * | 2/2013 | Hilshorst | C22B 1/00 75/10.67 |
| 2013/0125708 | A1 | | 5/2013 | Connelly et al. | |
| 2013/0276582 | A1 | | 10/2013 | Perera Mercado et al. | |
| 2014/0166787 | A1 | | 6/2014 | Gillis | |

FOREIGN PATENT DOCUMENTS

| | | | |
|---|---|---|---|
| CN | 1256188 | C | 5/2006 |
| CN | 101116841 | A | 2/2008 |
| CN | 101138744 | A | 3/2008 |
| CN | 100592933 | C | 3/2010 |
| CN | 101161349 | B | 3/2011 |
| CN | 201997371 | U | 10/2011 |
| CN | 202129144 | U | 2/2012 |
| CN | 202666976 | U | 1/2013 |
| CN | 202762516 | U | 3/2013 |
| DE | 2749380 | A1 | 5/1979 |
| DE | 3416504 | A1 | 11/1985 |
| DE | 3644403 | A1 | 7/1988 |
| DE | 4032367 | A1 | 4/1992 |
| DE | 4100346 | A1 | 7/1992 |
| DE | 102004050720 | A1 | 4/2006 |
| EP | 0733405 | A1 | 9/1996 |
| EP | 2803416 | A1 | 11/2014 |
| EP | 2689854 | B1 | 8/2015 |
| FR | 1510164 | A | 1/1968 |
| GB | 2006735 | A | 5/1979 |
| GB | 2284165 | A | 5/1995 |
| IN | 201300313 | I2 | 9/2014 |
| JP | H09151386 | A | 6/1997 |
| JP | 2003275938 | A | 9/2003 |
| JP | 3582011 | B2 | 10/2004 |
| JP | 4741455 | B2 | 8/2011 |
| KR | 100353520 | B1 | 9/2002 |
| KR | 100416938 | B1 | 1/2004 |
| KR | 100423440 | B1 | 3/2004 |
| KR | 100432525 | B1 | 5/2004 |
| LU | 41376 | A1 | 5/1962 |
| RU | 2156661 | C2 | 9/2000 |
| RU | 2241544 | C2 | 12/2004 |
| RU | 2329105 | C1 | 7/2008 |
| SU | 825152 | A1 | 4/1981 |
| SU | 1609495 | A1 | 11/1990 |
| UA | 80521 | C2 | 9/2007 |
| WO | WO 200328893 | A1 | 4/2003 |
| WO | WO 2011049229 | A1 | 4/2011 |
| WO | WO 2012008032 | A1 | 1/2012 |
| WO | WO 2012131906 | A1 | 10/2012 |
| WO | WO 2013138889 | A1 | 9/2013 |

OTHER PUBLICATIONS

Anonymous, "Dry, magnetic concentration of iron ores," Canadian Mining Journal, May 1964, pp. 70 + 72, vol. 85, issue 5.

Anonymous, "Symposium on iron ore treatment held at Metz on Oct. 8, 1957," Institut de Recherches de la Siderugie—Colloque, Aug. 1958.

Australia Patents Act 1990, "Statement of Grounds and Particulars," IP Australia, 5 pages.

Bergerman et al., "Regrind of metallic ores with Vertical Mills: an overview of existing plants in Brazil." Gecamin. Proceedings: XXVII International Mineral Processing Congress. 2014., pp. 1-10.

Brundiek, "Roller mill application for high moisture feed." Cement Industry Technical Conference. 1997. XXXIX Conference Record, 1997 IEEE/PCA. IEEE, 1997, pp. 213-225.

En, "On the Combined Effect of AC and DC Magnetic Fields in a Dry-Type Magnetic Separator," IEEE Transactions on Magnetics, Nov. 1982, pp. 1701-1703, vol. MAG-18, No. 6.

Everard. "Dry autogenous grinding and dry magnetic separation of iron ores," Society of Mining Engineers—Transactions, Mar. 1962, pp. 88-96, vol. 223, issue 1.

Fridenberg, "A Fine Carbonyl Iron Powder for High-Frequency Magnetic Powder Materials," Powder Metallurgy and Metal Ceramics, 1964, pp. 23-29, vol. 2, issue 1.

Hajati, "A Novel Approach to Optimize Grinding Circuits-Modelling Strategy to Monitor Ball Mill Particle Size Distribution Data at Lakan Plant," IJST, Transactions of Mechanical Engineering, Apr. 2011, pp. 85-100, vol. 35, No. M1.

Hixon et al., "Sizing Materials by Crushing and Grinding," Chemical Engineering, Nov. 1990, pp. 94-103, vol. 97, No. 11.

Kolosov et al., "New technical solutions for applying the dry magnetic separation in technology for concentration at the operating ore-mining and processing enterprises," Chernaya Metallurgiya. Byulleten' Nauchno-Tekhnicheskoj Informatsii (Russia), 2002, pp. 20-23, vol. 1.

Koshkalda et al., "Intensifying the Dry Magnetic Beneficiation of Iron Ores," Metallurgist, 2007, pp. 417-419, vol. 51, Nos. 7-8.

Laurila, "Magnetic separators with permanent magnets for dry dressing of finely dispersed, strongly magnetic iron ores," Stahl and Eisen, Dec. 2, 1954, pp. 1659-1661, vol. 74, issue 25.

Prasath, et al., "Application of Soft Constrained MPC to a Cement Mill Circuit," IFAC Proceedings, 2010, pp. 302-307, vol. 43, No. 5.

Rikers, "Improved method for prediction of heavy metal recoveries from soil using high intensity magnetics separations (HIMS)," International Journal of Mineral Processing, 1998, pp. 165-182, vol. 54.

Roy, "Increasing cement grinding capacity with vertical roller mill technology." Cement Industry Technical Confernece, 2002. IEEE-IAS/PCA 44th. IEEE, 2002., pp. 205-211.

(56) References Cited

OTHER PUBLICATIONS

Sahni, et al., "Contact drying: A review of experimental and mechanistic modeling approaches," International Journal of Pharmaceutics, 2012, pp. 334-348, vol. 434.
Shuey, "Mill Technology: New Generations and the Reinvented Standby," Engineering and Mining Journal, May 2002, pp. 34-40, vol. 203, No. 5.
Singh et al, "Iron ore resources and beneficiation practices," 2007, pp. 1-16.
Veasey "An overview of metals recycling by physical separation methods," Proceedings of the Institution of Mechanical Engineers, 1997, pp. 61-64, vol. 211, No. 1.
Voorhees, "How to operate an air classifier mill to meet your fine grinding goals," PBE, Jun. 2013, CSC Publishing, 5 pages.
Xing et al., "Decontamination of granular wastes by mining separation techniques," Journal of Cleaner Production, 2006, pp. 748-753, vol. 14.
Statutory Declaration from Christiaan Aldrich issued in Australian Patent Application No. 2013334500, dated May 26, 2018 (including Annexure CA1, Harmonised Expert Witness Code of Conduct, Doc ID 1002119946 and Annexure CA2, Résumé—Chris Aldrich (Deng, PhD), Western Australian School of Mines, Curtin University, Australia, Annexure CA3, U.S. Pat. No. 5,961,055 and Annexure CA4, U.S. Pat. No. 3,754,713), pp. 1-58.
Statutory Declaration from Seher Ata issued in Australian Patent Application No. 2013334500, dated May 28, 2018 (including Annexure SA1, Harmonised Expert Witness Code of Conduct, Doc ID 1002120950, Annexure SA2, Curriculum Vitae, Associate Professor Seher Ata, PhD in Chemical Engineering from The University of Newcastle, Newcastle, AU, Annexure SA3 chart, Annexure SA4, Wills' Mineral Processing Technology, Seventh Addition, Annexure SA5, Introduction to Mineral Processing by Kelly and Spottiswood, Annexure SA6, WO 2014/063211 WO2013/138889.
Statutory Declaration from Mauro Fumyo Yamamoto in Australian Patent Application No. 2013334500, dated May 25, 2018, pp. 1-2.
Statement of Grounds and Particulars issued in Australian Patent Application No. 2013334500, dated May 28, 2018, pp. 1-6.
Opposition to Australian Patent Application No. 2013334500 Iron ore concentration process with grinding circuit, dry desliming and dry or mixed (dry and wet) concentration in the name of Vale S.A., dated May 28, 2018, pp. 1-2.

* cited by examiner

--PRIOR ART--

--PRIOR ART--

IRON ORE CONCENTRATION PROCESS WITH GRINDING CIRCUIT, DRY DESLIMING AND DRY OR MIXED (DRY AND WET) CONCENTRATION

CROSS REFERENCE TO RELATED APPLICATION

This application claims priority from U.S. Provisional Application No. 61/719,143, entitled "Specification for Iron Ore (Itabirite) Concentration Process with Milling Circuit and Dry Desliming and Dry or Wet Concentration," filed on Oct. 26, 2012, and which is incorporated herein by reference.

FIELD OF THE INVENTION

The present invention relates to a concentration process for iron ores, which can be fully dry or mixed, part of the process being dry, part wet.

BACKGROUND OF THE INVENTION

A concentration facility, hereinafter referred to as "Concentrator," is typically defined by a combination of one or more unit operations. Concentrators are usually large-scale facilities capable of processing thousands of tons of ore per day.

To recover metals and other minerals for use in industrial processes, significant quantities of ore or rock are mined, crushed, pulverized and processed. Nowadays, it is often desirable to process minerals with contents above 35% iron to obtain concentrates with up to 68% iron. Such processes are carried out with dry and/or partially wet processing stages. Dry processing normally goes from mining (extraction of the ore in the mine) up to sieving and crushing operations. When processing natural fines from ores, a wet processing stage is conducted after the crushing operation and involves the addition of large quantities of water. This wet stage begins at grinding. Grinding is necessary to release metals and minerals from the ore or rock. Therefore, the mining industry produces large quantities of fine ore or rock particles where such fine grained wastes are known as "tailings."

The most common ore concentration process, capable of processing large quantities of ore, is flotation, carried out in mechanical cells or flotation columns. Flotation may require a desliming stage, which consists of the extraction of the natural ultrafines and can include extraction of those generated in the grinding process. This is done on a wet basis and requires the movement of large volumes of water, as well as the placement of sandy tailings and slimes from the process in dams.

FIG. 1 shows a flowchart typical of a known process in which all of the material originating from the mine is processed for the production of concentrates.

FIG. 2 shows a flowchart used for processing more complex minerals that require a second stage of grinding to guarantee the liberation of iron ore from the gangue.

The process of reverse flotation is already industrially used at various plants and companies.

The process of concentration after the first grinding stage, as described in FIG. 2, can be flotation or wet high intensity magnetic separation.

BRIEF SUMMARY OF THE INVENTION

In one embodiment, the invention provides an iron ore concentration process with grinding circuit, dry desliming and dry concentration, wherein the process comprises the steps of: crushing an ore; dry grinding of the ore crushed in step a); dry desliming of the ore grinded in step b); and magnetically separating the ore deslimed in step c), resulting in a concentrate product and a reject. Step b) may be performed by pneumatic classifiers, with a cut between about 90%<37 μm and about 90%<5 μm. Step d) is performed by magnetic drums using a combination of low and medium intensity magnetic fields followed by high gradient-high intensity magnetic roll separators. The iron ore concentration process may further include a regrinding step for ores with fine liberation sizes. The process may also be a fully dry concentration process.

In another embodiment, the invention provides an iron ore concentration process with dry grinding circuit, dry desliming and mixed (dry and wet) concentration, wherein the process is adapted for concentration of iron ores with course liberation sizes, and wherein the process comprises the steps of: crushing an ore; dry grinding of the ore crushed in step a); dry desliming of the ore grinded in step b); adding water to the ore deslimed in step c); floating or performing a wet high intensity magnetic separation, resulting in a reject that is separated; and filtering to obtain a concentrated product. Step b) may be performed by pneumatic classifiers with a cut between about 90%<37 μm and about 90%<5 μm. Step e) may further result in tailings, wherein the process further comprises: filtering the tailings and mixing the tailings with a dry sludge for dry stacking. Water from filtering step f) may be recirculated for use in step e) of the iron ore concentration process. The process may further comprise a wet high intensity magnetic separation.

In yet another embodiment, the invention provides an iron ore concentration process with dry grinding circuit, dry desliming and mixed (dry and wet) concentration, wherein the process is adapted for concentration of iron ores with fine liberation sizes and wherein the process comprises the steps of: A) crushing an ore; B) dry grinding of the ore crushed in step a); C) dry desliming of the ore grinded in step b); D) adding water to the ore deslimed in step c); E) floating to generate a reject that is separated; F) regrinding the concentrate obtained in step e); and G) filtering to obtain a concentrated product.

DETAILED DESCRIPTION OF THE INVENTION

In light of the above described results observed, the present invention describes an advantageous and effective process for the concentration of iron ores, which can be fully dry or mixed, part of the process being dry, part wet, thereby enhancing the process efficiency as a whole by increasing recovery of concentrators and increasing the useful life of the mines.

The following detailed description does not intend to, in any way, limit the scope, applicability or configuration of the invention. More specifically, the following description provides the necessary understanding for implementing the exemplary embodiments. When using the teachings provided herein, those skilled in the art will recognize suitable alternatives that can be used, without extrapolating the scope of the present invention.

The present invention is directed to an ore concentration process, embodiments of which are shown in FIGS. 3 to 6.

The process of the present invention comprises the following steps:

| For a fully dry process | For a mixed (dry and wet) process |
|---|---|
| a) Crushing an ore;<br>b) Dry grinding of the ore crushed in step a);<br>c) Dry desliming of the ore milled in step b);<br>d) Magnetic separation of the ore deslimed in step c), resulting in a concentrate product and a reject that is separated | a) Crushing an ore;<br>b) Dry grinding of the ore crushed in step a);<br>c) Dry desliming of the ore milled in step b);<br>d) Adding water to the ore deslimed in step c)<br>e) Flotation, resulting in a reject that is separated;<br>f) Filtration, obtaining a concentrated product |

The terms grinding and milling may be used interchangeably. Grinding or milling is designed to break a solid material into smaller pieces.

According to preferred embodiments of the present invention, the slimes originating from desliming are dry produced by pneumatic classifiers, with a cut that may be between about 90%<37 μm and about 90%<5 μm. In the mixed process, tailings from flotation should be filtered and mixed to the dry sludge for placement into piles. The water from filtering the tailings is recirculated in the concentration.

Figure 1:
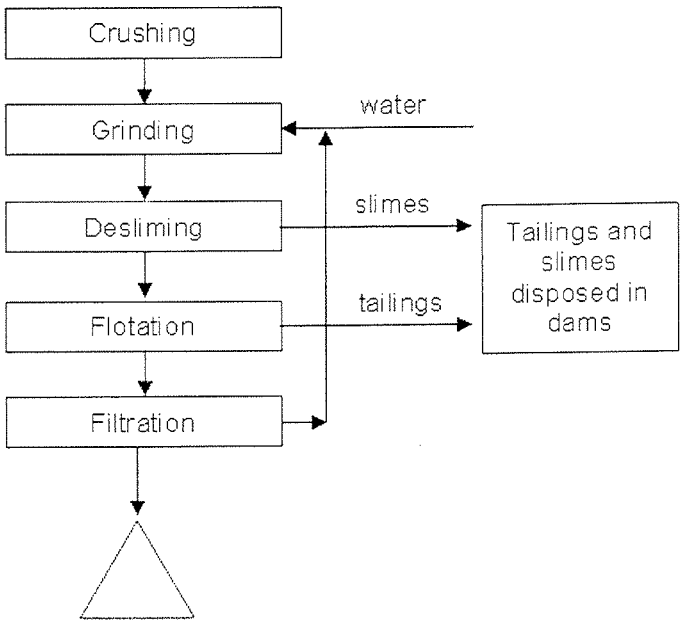
FIG. 1 shows a flowchart for concentration of iron ores with one stage of grinding, usually used for ores with coarse liberation sizes known from the state of the art.
Figure 2:
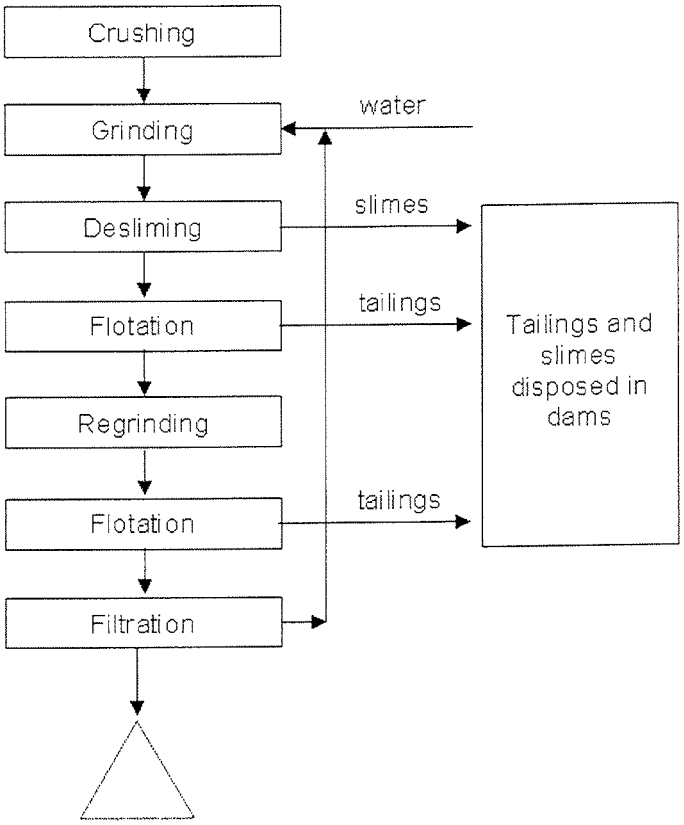
FIG. 2 shows a flowchart for concentration of ores with two stages of grinding, usually used for ores with fine liberation sizes known from the state of the art.
Figure 3:
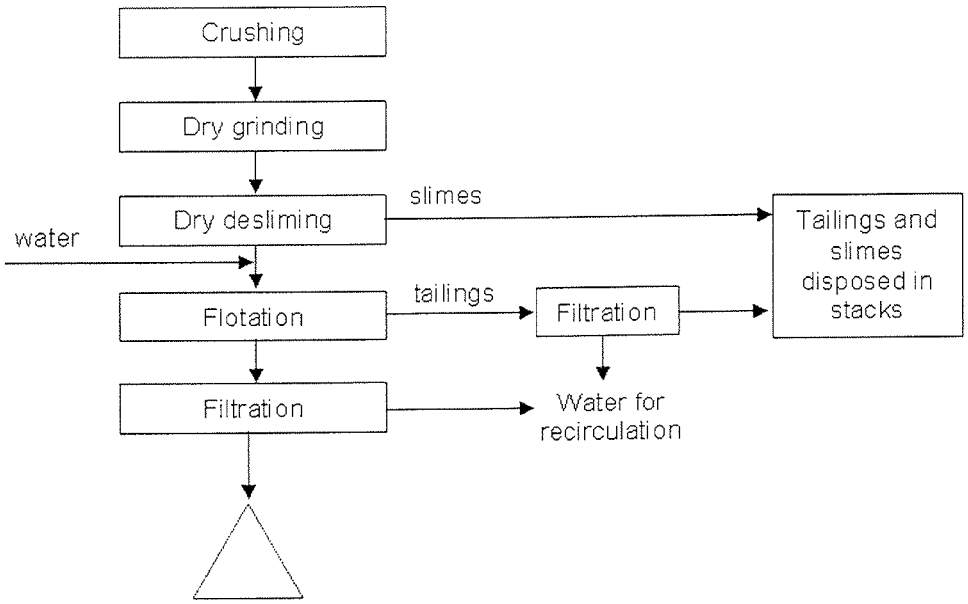
FIG. 3 shows a mixed flowchart (dry and wet) for concentration of ores with one stage of grinding, usually used for ores with coarse liberation sizes according to the present invention.
Figure 4:
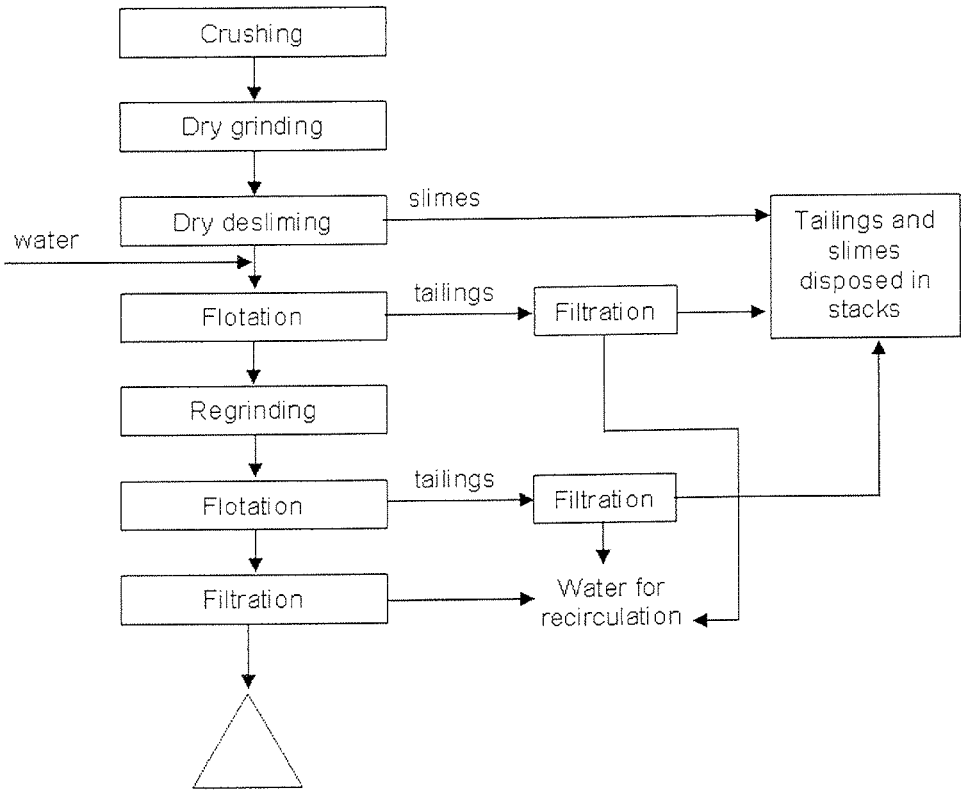
FIG. 4 shows a mixed flowchart (dry and wet) for concentration of iron ores with two stages of grinding, usually used for ores with fine liberation sizes according to the present invention.

The first concentration stage shown in FIGS. 3 and 4 can be replaced by wet high intensity magnetic separation.

Figure 5:
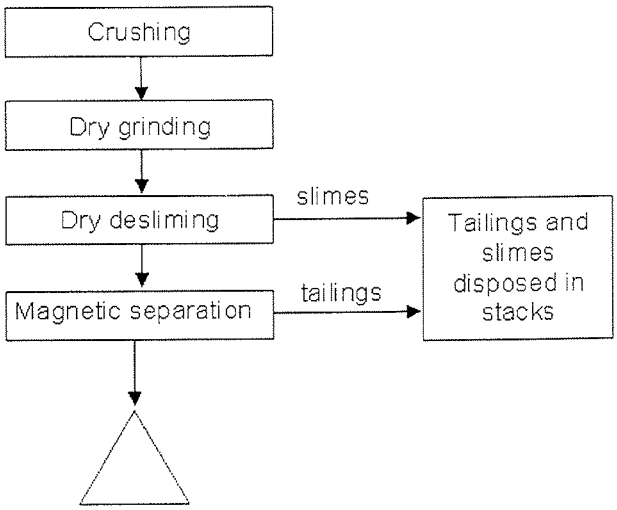
FIG. 5 shows a flowchart for dry concentration of iron ores with one stage of grinding, usually used for ores with coarse liberation sizes according to the present invention.
Figure 6:
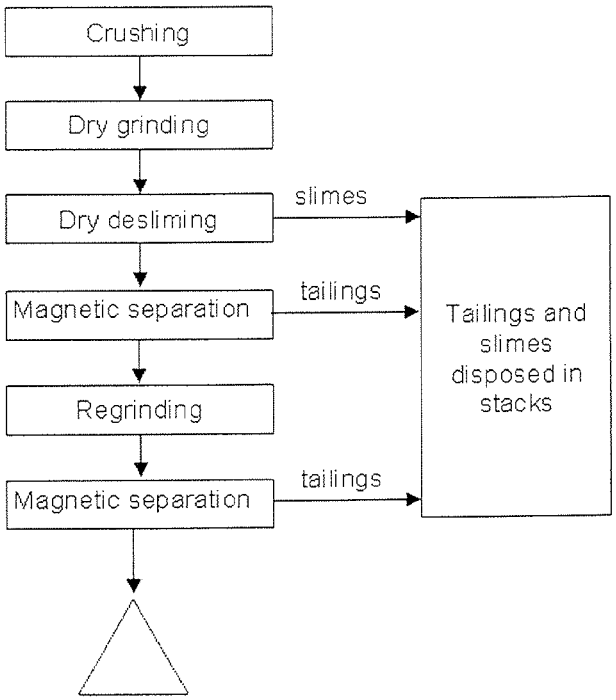
FIG. 6 shows a flowchart for dry concentration of iron ores with two stages of grinding, usually used for ores with fine liberation sizes according to the present invention.

Alternatively to wet concentration, a fully dry concentration process is presented in FIGS. 5 and 6, in which concentration is performed firstly by magnetic drums using a combination of low and medium intensity magnetic field and afterwards by high gradient-high intensity magnetic roll separators.

The need for desliming in the process of concentration by flotation is well known. However, the ultrafines also adversely affect the dry magnetic concentration. As a result of the stage of dry desliming, the process according to the present invention has an advantage in relation to the conventional path of dry concentration, where there is no desliming. An example is shown in Tables 1 and 2 below.

TABLE 1

Results of magnetic concentration of deslimed sample.

| Stage | Flow | Mass (g) | Fe | $SiO_2$ |
|---|---|---|---|---|
| 1st stage medium intensity magnetic drum | Feed | 7820.6 | 42.98 | 36.35 |
| | Concentrate 1 | 3164.3 | 67.49 | 2.78 |
| | Tail 1 | 4656.3 | 28.63 | 58.41 |
| 2nd stage medium intensity magnetic drum | Concentrate 2 | 703.6 | 67.41 | 2.96 |
| | Tail 2 | 3952.7 | 20.44 | 69.43 |
| 3rd stage high gradient high intensity magnetic roll | Concentrate 3 | 2043.9 | 37.68 | 43.39 |
| | Tail 3 | 1908.8 | 1.98 | 97.31 |
| 4th stage high intensity roll | Concentrate 4 | 1054.4 | 64.14 | 6.80 |
| | Tail 4 | 989.5 | 10.63 | 81.34 |
| Final Concentrate | | 4922.3 | 66.76 | 3.67 |
| Final Tail | | 2898.3 | 4.93 | 91.86 |

| | |
|---|---|
| Mass yield (%) | 61.54 |
| Metallurgical recovery (%) | 95.59 |
| Gaudin's selectivity index | 18.41 |

TABLE 2

Results of magnetic concentration of non-deslimed sample.

| Stage | Flow | Mass (g) | Fe | $SiO_2$ |
|---|---|---|---|---|
| 1st stage medium intensity magnetic drum | Feed | 8833.3 | 42.00 | 37.80 |
| | Concentrate 1 | 2372.2 | 59.28 | 12.72 |
| | Tail 1 | 6461.1 | 38.08 | 44.04 |
| 2nd stage medium intensity magnetic drum | Concentrate 2 | 2031.8 | 60.87 | 10.66 |
| | Tail 2 | 340.4 | 52.89 | 22.77 |
| 3rd stage high gradient high intensity magnetic roll | Concentrate 3 | 62.3 | 60.97 | 10.83 |
| | Tail 3 | 6398.8 | 35.47 | 47.45 |
| Final Concentrate | | 2094.1 | 60.87 | 10.67 |
| Final Tailing | | 6739.2 | 36.35 | 46.20 |

| | |
|---|---|
| Mass yield (%) | 23.04 |
| Metallurgical recovery (%) | 33.99 |
| Gaudin's selectivity index | 2.69 |

Table 1 shows that with the stage of desliming it was possible to obtain a concentrate with 66.76% Fe and tailings with just 4.93% Fe. However, the same sample that was not deslimed generated a concentrate with Fe content of 60.87%, which does not meet market specifications and tailings with 36.35% Fe, which causes a major loss of useful mineral.

The advantages obtained with the process of the present invention:

- Disposal of coarse and ultrafine tails in stacks reducing the environmentally impacted areas in comparison with the large areas needed for the wet process inherent to the dam arrangement form.
- Enhanced processing efficiency as a whole increasing recovery of concentrators and whereby increasing the useful life of the mines.
- Enhanced quality of the generated concentrate, which has a higher Fe content and lower $SiO_2$ content compared to the conventional process.

The invention claimed is:

1. An iron ore concentration process with grinding circuit, dry desliming and dry concentration, wherein the process comprises the steps of:

a) crushing an iron ore;

b) dry grinding of the iron ore crushed in step a);

c) dry desliming of the iron ore grinded in step b); and d) magnetically separating the iron ore deslimed in step c), resulting in a concentrate iron product and a reject that is separated, wherein step c) is performed by pneumatic classifiers, with a cut of 90%<37 μm, wherein step d) is performed by magnetic drums using a combination of first and second intensity magnetic fields followed by a magnetic roll separator having a third intensity magnetic field and a gradient, wherein the third intensity magnetic field is higher than the second intensity magnetic field, and the second intensity magnetic field is higher than the first intensity magnetic field, and wherein the process is a fully dry concentration process.

2. The iron ore concentration process according to claim 1 wherein the process is applied for concentration of iron ores with one stage of grinding, including ores with coarse liberation sizes.

3. The iron ore concentration process according to claim 1, wherein the process is applied for concentration of iron ores with two stages of grinding and regrinding, including for ores with fine liberation sizes.

4. The iron ore concentration process according to claim 1, further comprising obtaining slimes and tailings, and disposing said slimes and tailings in stacks.

5. The iron ore concentration process according to claim 1, wherein the concentrate iron product has up to 68% iron.

6. The iron ore concentration process according to claim 1, wherein step c) is performed by pneumatic classifiers, with a cut of 90%<5 μm.

* * * * *